US005219013A

United States Patent [19]

Rozon

[11] Patent Number: 5,219,013

[45] Date of Patent: Jun. 15, 1993

[54] CURTAIN RETAINER

[75] Inventor: David P. Rozon, Russell, Canada

[73] Assignee: Bernel (139088 Canada Ltd.), Hull, Canada

[21] Appl. No.: 734,788

[22] Filed: Jul. 23, 1991

[30] Foreign Application Priority Data

Jul. 27, 1990 [CA] Canada ..... 2022196

[51] Int. Cl.[5] ..... E06B 9/38

[52] U.S. Cl. ..... 160/38; 160/178.1; 160/395

[58] Field of Search ..... 160/38, 39, 19, 383, 160/392, 395, 330, 327, 368.1, 178.1

[56] References Cited

U.S. PATENT DOCUMENTS

| | | | |
|---|---|---|---|
| 3,111,162 | 11/1963 | Bierlich | 160/38 X |
| 3,166,286 | 1/1965 | Pfaff | 160/39 X |
| 3,205,547 | 9/1965 | Riekse . | |
| 3,646,641 | 3/1972 | Roben . | |
| 3,783,931 | 1/1974 | Assael | 160/327 |
| 4,114,233 | 9/1978 | Hamilton | 160/38 X |
| 4,189,880 | 2/1980 | Ballin | 160/392 X |
| 4,233,790 | 11/1980 | Meadows | 160/395 X |
| 4,828,002 | 5/1989 | Ashby | 160/38 |
| 4,840,216 | 6/1989 | John | 160/38 X |
| 4,912,900 | 4/1990 | Yeamans | 160/395 X |
| 4,921,031 | 5/1990 | Wagner et al. | 160/38 |
| 4,926,605 | 5/1990 | Milliken et al. | 160/395 X |
| 4,935,988 | 6/1990 | Ford et al. | 160/38 X |
| 4,957,255 | 9/1990 | John | 160/38 X |

FOREIGN PATENT DOCUMENTS 1015998 9/1957 Fed. Rep. of Germany .

*Primary Examiner*—David M. Purol
*Attorney, Agent, or Firm*—Adrian Zahl

[57] ABSTRACT

The present invention relates to a curtain retainer. The curtain retainer is comprised of a retainer element having a pair of parallel elongate members having a gap therebetween and having inside and outside faces. A support is provided to support the retaining element from a wall, ceiling, head rail of a window blind or curtain, or the like. A plug is provided for insertion into and retained within the gap in the retaining element. The plug clampingly engages fabric of a curtain between itself and corresponding inside faces of the members. The plug is retained in a partly recessed position within the gap and is capable, in this position, of retaining the fabric sufficiently loosely to allow for positioning of the fabric in pleats or the like.

10 Claims, 7 Drawing Sheets

CURTAIN RETAINER

The present invention relates to a curtain retaining device of the type commonly used to grip a fabric valance fringing the upper margin of a curtain or window blind. The device may also be adapted to engage the fabric of a curtain.

Devices known to the art for grippingly engaging the fabric of a valance or curtain generally comprise a slotted tube, having an inner retaining rod or plug positioned inside the tube and extending the length of it. Part of the fabric is engaged by or wrapped around the retaining rod, the remaining fabric extending outwardly from the slot. These devices are assembled by initially separating the retaining rod from the tube; wrapping the fabric around the rod in a desired pleated pattern; and inserting the rod and fabric into an open end of the tube, with the surplus fabric extending outwardly from the slot. Once assembled, tension on the fabric causes the fabric to be gripped between the rod and the tube. A variety of means may be provided to prevent the rod from rotating within the tube, and to engage the fabric with the rod, as exemplified by Canadian Patents 174,745 and 231,769. Devices of this type provide an inexpensive and expeditious alternative to manually stitching pleated or straight fabric to a rod.

Devices known to the art suffer the limitation that the pleated curtain must be perfectly pleated in its final form prior to assembly of the device by insertion of the rod within the tube. Once the rod is positioned within the tube, the fabric is gripped tightly and it is difficult to adjust the pleating. Further, it is difficult to adapt those known devices to extend around a corner, for example where it is desired to extend a valance around the edge of a set of blinds to abut an adjacent wall.

Additionally, known retaining devices comprise a single rigid unit extending the width of the curtain or blind. It is on occasion desirable to provide a segmented retainer, either to provide a less expensive assembly or to allow for such individual segments to be slidably mounted on a track. This form of attachment allows the user to suspend an openable curtain directly from the retainer.

In accordance with one aspect of the invention there is provided a curtain retainer comprising: (a) a retainer element having a pair of parallel elongate members having a gap therebetween and having inside and outside faces; (b) support means to support said retaining element from a wall, ceiling, head rail of a window blind or curtain, or the like; and (c) a plug adapted to be inserted into and retained within said gap and clampingly engage fabric of a curtain between the plug and corresponding inside faces of the members, the plug being retained in a partly recessed position within the gap and capable in this position of retaining the fabric sufficiently loosely to allow for positioning of the fabric in pleats or the like.

In a preferred embodiment, the curtain retainer comprises an arrangement of several such members and plugs, each slidably mounted on a rail.

The invention will now be described by way of preferred embodiments thereof and illustrated by the accompanying drawings, in which:

FIGS. 1 and 2 are illustrative of both embodiments described herein.

Figure 1:
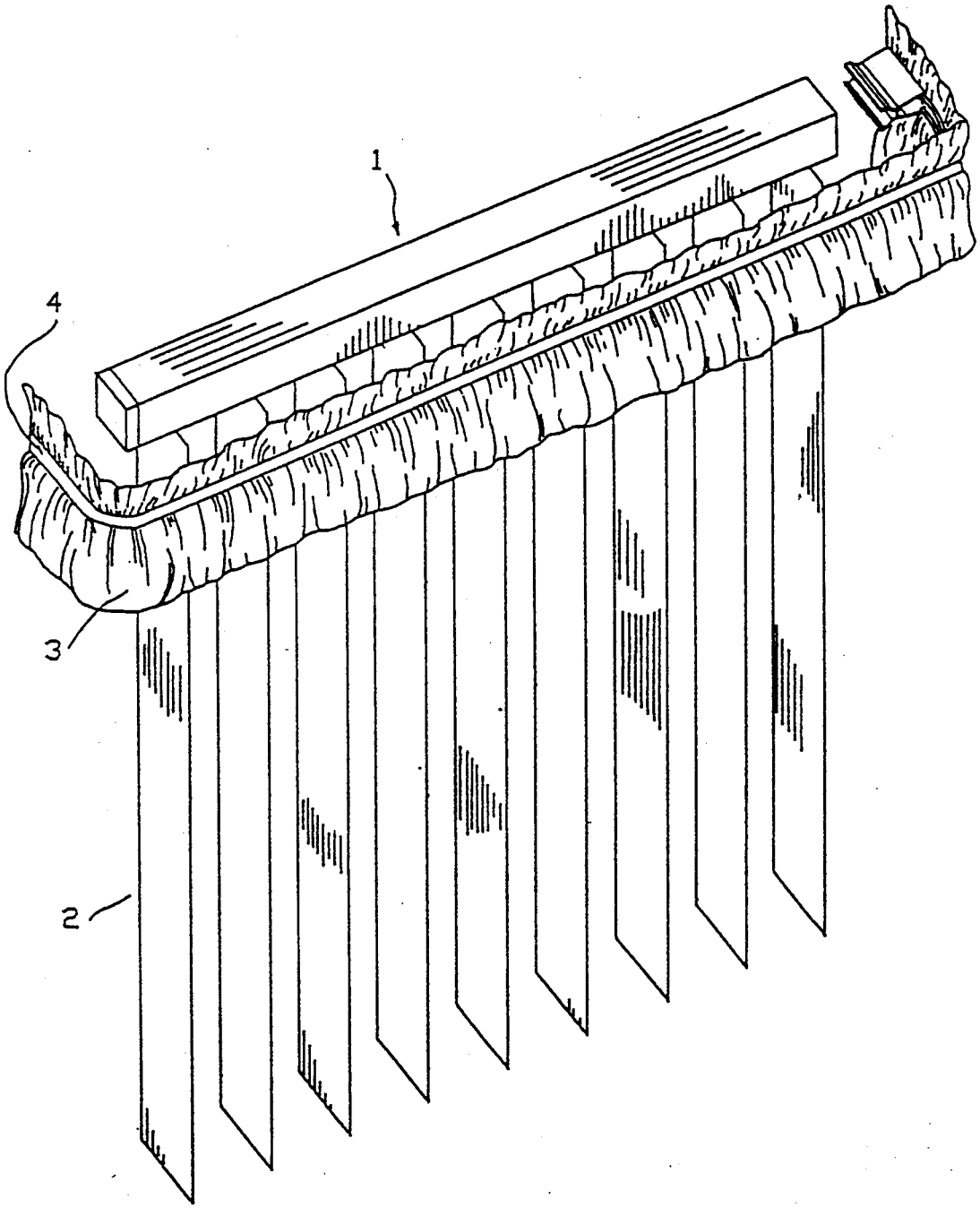
FIG. 1 is a perspective of a curtain retainer according to the present invention, illustrating a curtain valance retained thereby and a window blind suspended therefrom.

Referring to FIG. 1, a head 1 of a window blind may be mounted to a wall or ceiling by conventional means, not illustrated. A blind 2 is suspended therefrom. The means for suspending a window blind from a head rail are known and do not comprise a part of this invention. A fabric valance 3 is engaged to the head 1 by a curtain retainer 4 according to the present invention.

Figure 2:
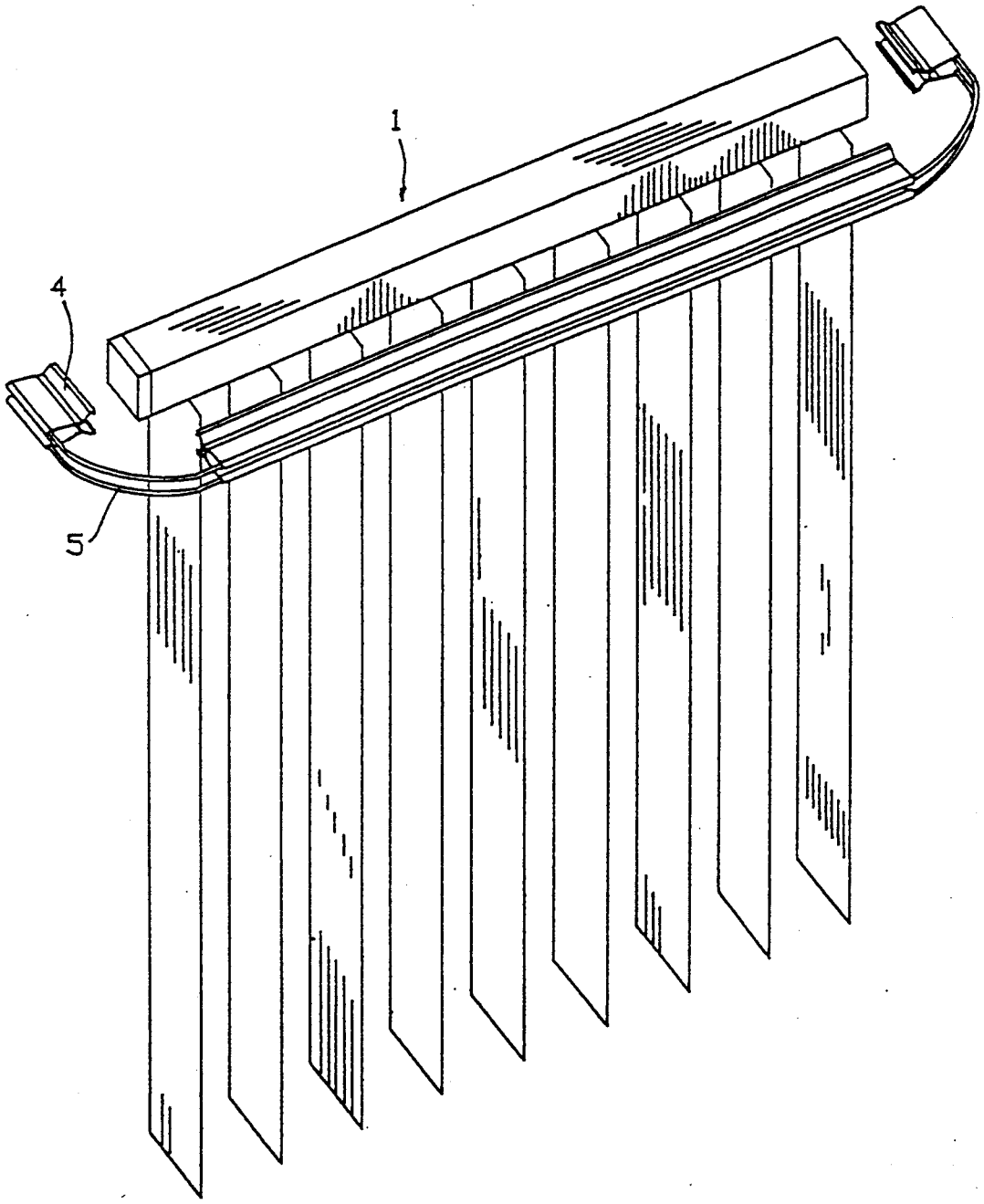
FIG. 2 is a perspective view of a curtain retainer, with the valance removed and a window blind suspended therefrom.

Referring to FIG. 2, the curtain retainer 4 is mounted to the head 1. In the embodiment illustrated, the curtain retainer includes a corner element 5, which allows the curtain valance suspended therefrom to fully enclose the head 1.

Figure 3:
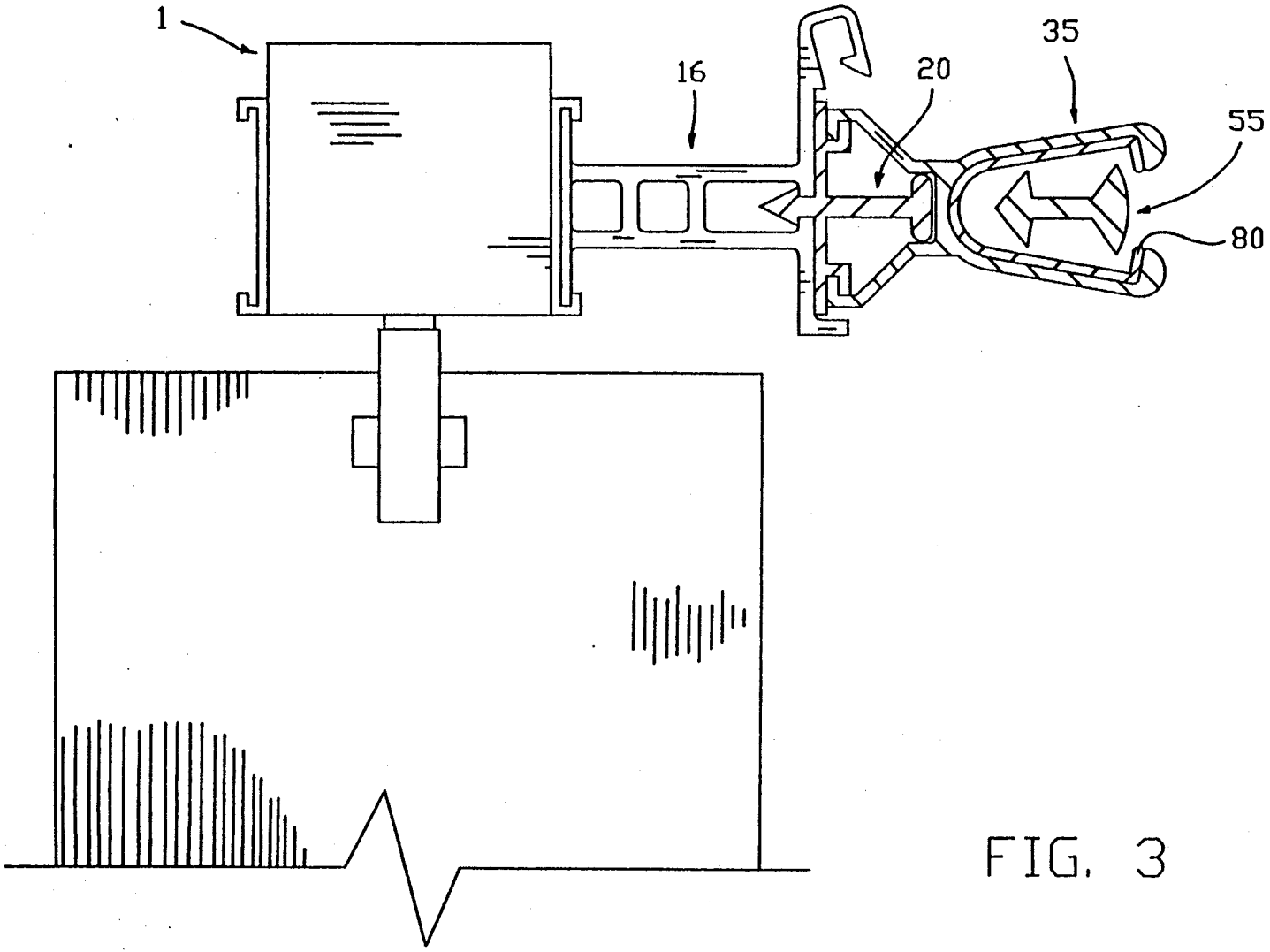
FIG. 3 is a side view, in section, of a first embodiment of the curtain retainer.
Figures 4, 5:
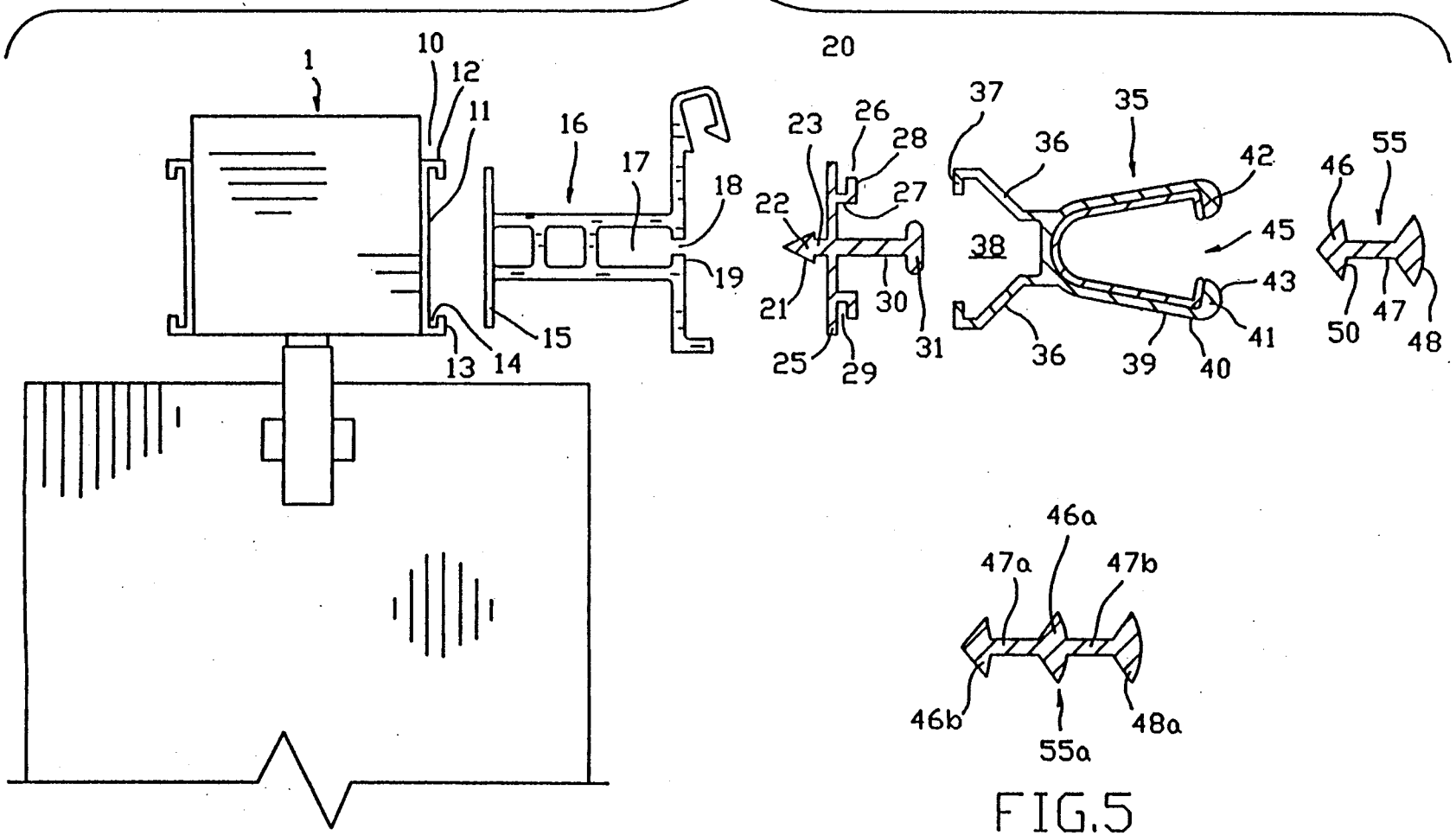
FIG. 4 is a side view in section and exploded, illustrating the components of the device.
FIG. 5 is a side view, in section, of an alternative embodiment of the plug portion of the device.

A first embodiment of the invention is illustrated in FIGS. 3 and 4. The head 1 is provided with a mount 10 extending outwardly from the front face thereof. The mount is comprised of a backing plate 11 and extensions 12. The extensions 12 each have an inwardly-oriented overhanging lip 13, and together the extensions 12 form a channel 14 adapted to engage a flat backing plate 15 comprising the rear face of a valance holder 16. The valance holder is adapted to receive either a curtain retainer according to the present invention or a window blind vane (not illustrated), the latter being horizontally held by clips adapted for the purpose. The valance holder 16 is provided with a hollow chamber 17 extending the length thereof and having a slot 18 communicating with the front face of the valance holder. The slot 18 is defined by shoulders 19 forming the forward wall of the chamber 17. A spacer 20 is engaged by the valance holder 16. The spacer 20 has a mount 21 extending rearwardly therefrom. The mount 21 is comprised of a triangular head 22 and a neck 23. The length of the neck 23 is approximately the same as the width of the shoulders 19, allowing the mount 21 to be snap-fitted into and tightly engaged by the valance holder 16.

The valance holder 16 is fabricated of a flexible material such as polycarbonate or nylon, allowing the spacer 20 to be snap-fitted thereto.

The spacer 20 has a vertical backing plate 25, adapted to rest against the forward face of the valance holder 16 when these two elements are engaged to each other. Angled extensions 26 extend forwardly from the forward face of the plate 25, and each having a horizontal part 27, terminating in a vertical part 28, defining a channel 29 between the backing plate 25 and vertical part 28. An extension 30 extends forwardly of the plate 25, and terminates in a broad head 31.

The spacer 20 is adapted to be retained by the valance holder 16, and in turn to retain curtain retainer 35. The curtain retainer 35 is provided with legs 36, each of which terminates in an inwardly oriented foot 37. The feet 37 are adapted to be engaged by the channels 29 of the spacer 20. At their inner ends, the legs 36 define a broad channel 38, the channel 38 being adapted to receive the head 31 of spacer 20 when the latter engages retainer 35. The forward part of retainer 35 is defined by a pair of forwardly-extending longitudinally oriented grippers 39. Each gripper 39 is comprised of a body 40 and an inwardly extending shoulder 41. The shoulders 41 have a flat inner surface 42 and a rounded outer surface 43. The grippers 39 define a longitudinally-extending channel 45, within which a fabric retaining plug 55 is received and retained.

Fabric retaining plug 55 comprises an arrow-shaped forward head 46, a neck 47 and a rearward head 48. The forward head 46 is provided with flat rear faces 50 engagable with inner faces 42 of shoulders 39. The rear faces 50 are angled slightly rearwardly so as to provide for releasable retention by the grippers 39 and to prevent creasing of the fabric.

Referring to FIG. 3, the device may optionally be provided with an extension element 80, slidably engaged within the channel 45. The extension element 80 is an elongate member with the same cross-sectional configuration as the channel 45 and adapted to fit tightly therein. Where it is desired to extend the length of the retainer 35, the extension element is extended longitudinally outwardly from an end of the retainer, and serves as an effective extension thereof.

FIG. 5 illustrates an alternative embodiment 55(*a*) of the plug, having the additional features of forward and rearward necks 47(*a*) and 47(*b*), joining an intermediate head 46(*a*). A forward head 46(*b*) and rearward head 48(*a*), having the same configuration as forward and rearward heads 46 and 48 of plug 55, constitute the forward and rearward components, respectively, of the alternate plug 55(*a*). The intermediate head 46(*a*) has generally the same configuration and serves the same function as the rearward head 48 of plug 55, as will be described below. The alternate plug 55(*a*) may be inserted within the channel 45, the intermediate head 46(*a*) being retained by the grippers 39 and the rearward head 48(*a*) remaining outside the channel 45 to provide a decorative element to the valance or curtain. The rearward head 48(*a*) also serves to crimp the fabric extending outside the retainer, against the retainer so as to provide a less billowing appearance of the fabric and more of a neatly pressed appearance.

In use, the device is assembled by initially engaging curtain fabric to the fabric retainer 35. The fabric retainer 35 may be placed upright on a table, the flat feet 37 resting on the table and the grippers 39 pointed up, while the fabric is positioned therein. The fabric is draped over the retainer 35 in approximately its final position, with loose folds where pleats are desired. Plug 55 is positioned against the fabric, head 46 thereof pointed downwardly towards channel 45 of the fabric retainer. Forward head 46 is then inserted into the grippers 39, and the plug 55 is initially loosely engaged in an intermediary position whereby the forward head 46 is retained within the channel 45 by shoulders 41, with the neck 47 extending part way out of the channel, and the rearward head 48 being fully outside the channel. The rounded outer surfaces 43 of feet 41 facilitate insertion of the head 46, and the flat inner face 42 of the feet releasably retain the forward head 46 within the channel. While the plug 55 is thus loosely retained, the fabric may be adjusted so as to complete an arrangement of a pleating or bunching pattern, the fabric being gripped sufficiently tightly to hold such pleats in place. In this intermediary position the plug retains the fabric sufficiently to allow the valance to be installed in its final position, although the fabric may still be shifted if pulled with sufficient force. For a more secure retention, the plug may be pushed further into the channel 45, such that the rearward head 48 is fully inserted within the channel 45, as illustrated in FIG. 3. In this final position, the fabric is gripped sufficiently tightly to prevent further movement thereof.

The retainer 35 is then mounted to spacer 20, the feet 37 of the former engaging channels 29 of the latter. The spacer 20 is then mounted to valance holder 16, the mount 21 of the former being inserted through slot 18 and into chamber 17 of the latter. Shoulders 19 of valance holder 16 engage head 22 to retain the spacer 20.

Figure 7:
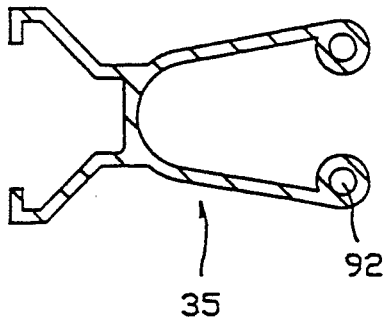
FIG. 7 is a side view, in section, of an end portion of the retaining element of the device.

An alternate embodiment of fabric retainer 35 is shown in FIG. 7. In that embodiment shoulders 41 which comprise the flat inner surface 42 and the rounded outer surface 43 is replaced by socket elements 92.

Figure 6:
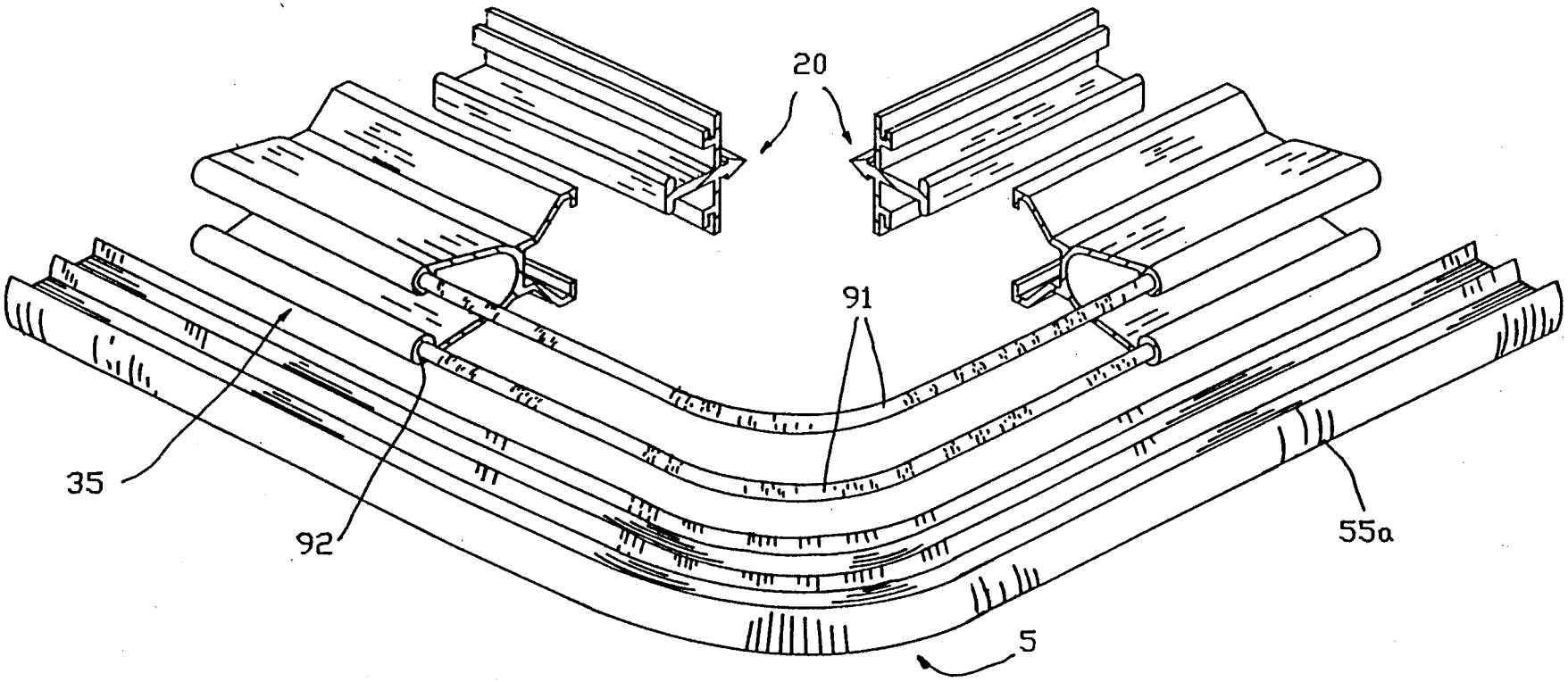
FIG. 6 is a perspective view of a corner element.

FIGS. 6 and 7 illustrate a corner element 5, comprised of a pair of spaced apart parallel bars 91, which may be bent to the desired extent to extend around a corner. The bars 91 are retained within the sockets 92 recessed into the exposed ends of the retainers 35, as particularly illustrated in FIG. 7. The bars 91 are positioned so as to retain the head and body portions of plug 55 or 55(*a*), the plug 55 or 55(*a*) being fabricated of a suitably flexible material capable of bending around a corner. It may be seen that this same construction utilizing parallel bars to retain the plug may be adapted to replace all or most of the retainer 35 by the use of a suitable means for holding the bars in position. For example, the bars 91 may be held in position along the whole length of the blind using short pieces of retainer 35.

Figure 8:
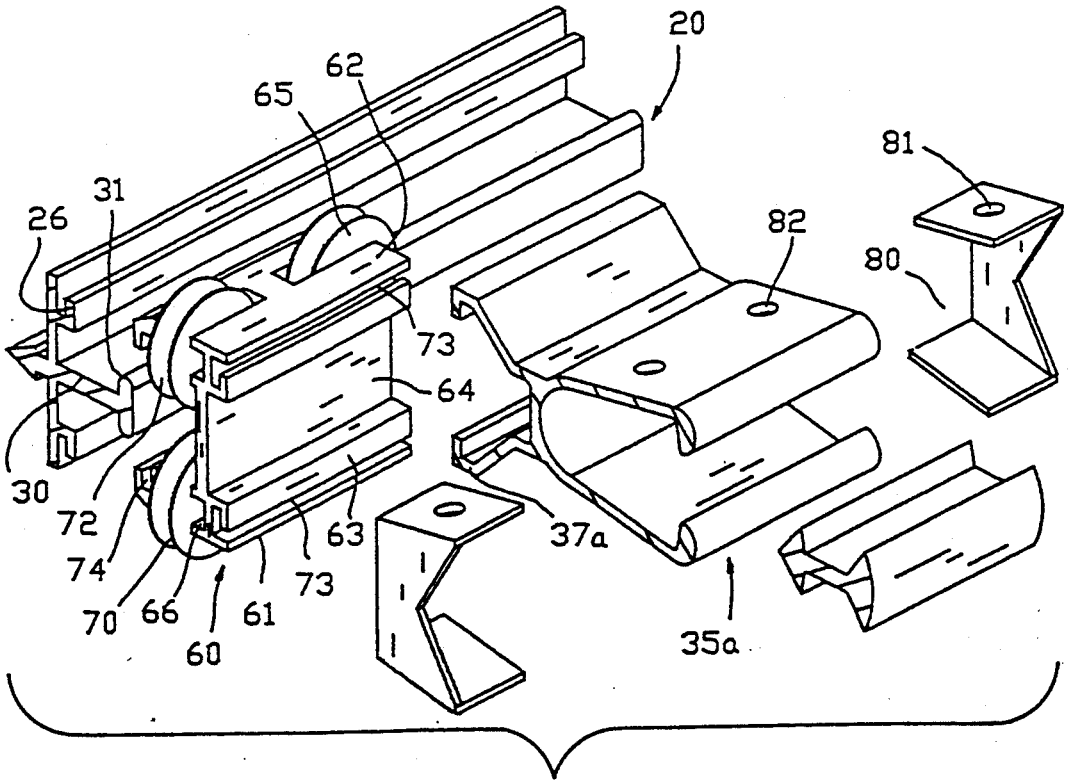
FIG. 8 is a perspective view, exploded, of a second embodiment of the device.
Figure 9:
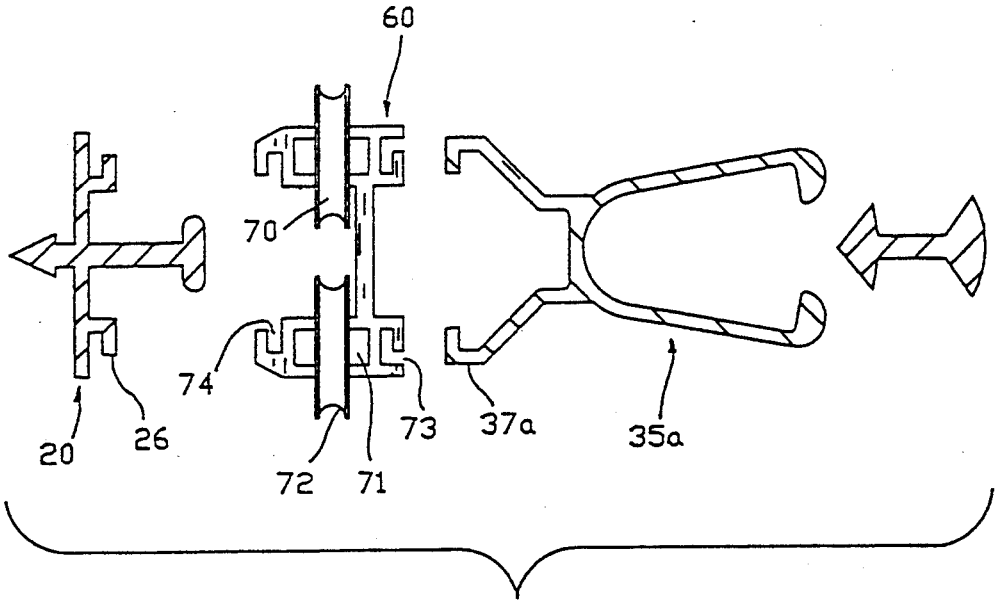
FIG. 9 is an exploded side view, in section, of the second embodiment.

In a second embodiment illustrated in FIGS. 8 and 9, multiple retainers 35(*a*) are provided, each comprising a short segment having the same configuration as retainer 35. Each retainer 35(*a*) is slidably mounted to spacer 20 by way of carriage 60. The spacer 20 is mounted to a valance holder (not illustrated) identical to that of the first embodiment. Referring to FIG. 8, carriage 60 is comprised of a frame 61 having upper and lower members 62 and 63 respectively, separated by vertical member 64. Each upper and lower member has a vertical wheel slot 65 and a horizontal hub slot 66 recessed into each end thereof, adapted to receive a wheel 70 and a hub 71 thereof, respectively (more particularly shown in FIG. 9). Wheel 70 is formed of nylon or other suitable low friction material, and spins freely on the hub 71. Each wheel 70 is provided with a concave rim 72 configured to engage the upper and lower faces of the extension 30 of spacer 20. The forward face of each upper and lower member 62 and 63 is provided with a channel 73 adapted to engage foot 37(*a*) of retainer 35(*a*). The rear face of each upper and lower member is provided with a channel 74 adapted to slidably engage angled extension 26 of spacer 20 in order to prevent jamming the carriage as it is pulled along the spacer 20.

Each end of carriage 60 is capped by an end cap 80, shown in FIG. 8, fixedly attached to the carriage by a screw 81 mounted in threaded hole 82 in the carriage.

In use, each retainer 35(*a*) is fixedly mounted to a corresponding carriage 60. Wheels 70 of the carriage 60 ride along the head 31 of extension 30. A number of such retainers 35(*a*) mounted to carriages 60 may be provided, each engaged to a portion of a curtain (not illustrated). With such an arrangement, the curtain may be opened and closed by pulling on a leading edge of the curtain. Alternatively, a draw string arrangement may be provided. Such draw string arrangements are well known to the art and are not illustrated.

I claim:

1. A curtain retainer comprising:

(a) a retainer element having a pair of parallel elongated members having a gap therebetween and having inside and outside faces;

(b) support means to support said retaining element from a wall, ceiling, or head rail of a window blind or curtain;

(c) a plug adapted to be inserted into a first position in which said plug is retained in a partly recessed position within said gap, and capable in this position of retaining a fabric material with sufficient force to allow for positioning of said fabric material in pleats or bunches in an installed position, and wherein said elongate members comprise a pair of rods.

2. The curtain retainer of claim 1, wherein said plug is further adapted to be inserted into a second position in which said plug is further inserted within said gap whereby said fabric material is clampingly engaged between said plug and said elongate members.

3. The curtain retainer of claim 2, wherein said plug is provided with a forward head, a neck, and a rearward head, said forward head adapted for insertion within said flanges to comprise the partly recessed position and said plug adapted to be further inserted such that said rearward head is retained by the flanges to comprise said second position.

4. The curtain retainer of claim 3, further wherein there is provided a third, decorative head spaced apart from said rearward head by a neck, said third head adapted to extend beyond said gap and crimp the fabric against the outside faces of said members.

5. The curtain retainer of claim 3, wherein said rearward head is adapted to extend outwardly beyond said flanges when the plug is in the partly recessed position and crimp the fabric flatly against the outside faces of said members.

6. The curtain retainer of claim 1, wherein said support means comprises a track and wherein a plurality of said retainer elements and corresponding plugs are provided, at least one of said retainer elements being slidably engaged to the track.

7. The curtain retainer of claim 1, wherein said retainer element is provided with radial extensions, the free ends of which are planar and are adapted to balance the retainer element on a flat surface while the fabric is being inserted into the gap, prior to assembly of the curtain retainer.

8. The curtain retainer of claim 7, wherein said radial extensions comprise the support means.

9. The curtain retainer of claim 1, wherein said rods include a curved portion and said plug includes a correspondingly curved portion, adapted to allow the curtain retainer to extend around a corner.

10. A curtain retainer comprising:

(a) a retainer element having a pair of parallel elongated members having a gap therebetween and having inside and outside faces;

(b) support means to support said retaining element from a wall, ceiling, or head rail of a window blind or curtain;

(c) a plug adapted to be inserted into a first position in which said plug is retained in a partly recessed position within said gap, and capable in this position of retaining a fabric material with sufficient force to allow for positioning of said fabric material in pleats or bunches in an installed position, and wherein said pair of elongate members each has a distal end portion which form opposing lips to form said gap in said retainer element, each lip having a socket, said retainer element further comprising a pair of rods inserted into said sockets, said rods including a curved portion adapted to allow said curtain retainer to extend around a corner.

* * * * *